US009218902B2

(12) United States Patent
Karrer et al.

(10) Patent No.: US 9,218,902 B2
(45) Date of Patent: Dec. 22, 2015

(54) POWER TRANSFORMER WITH ELECTRONIC COMPONENTS

(71) Applicants: Volker Karrer, Regensburg (DE); Karsten Viereck, Regensburg (DE); Alexander Reich, Mintraching (DE)

(72) Inventors: Volker Karrer, Regensburg (DE); Karsten Viereck, Regensburg (DE); Alexander Reich, Mintraching (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 14/371,212

(22) PCT Filed: Feb. 18, 2013

(86) PCT No.: PCT/EP2013/053175

§ 371 (c)(1),
(2) Date: Sep. 12, 2014

(87) PCT Pub. No.: WO2013/139541

PCT Pub. Date: Sep. 26, 2013

(65) Prior Publication Data

US 2015/0009001 A1 Jan. 8, 2015

(30) Foreign Application Priority Data

Mar. 21, 2012 (DE) ..... 10 2012 102 398

(51) Int. Cl.

| | |
|---|---|
| ***H01F 21/08*** | (2006.01) |
| ***H01F 17/06*** | (2006.01) |
| ***H01F 27/34*** | (2006.01) |
| ***H01F 27/40*** | (2006.01) |
| ***H01F 27/28*** | (2006.01) |
| ***H01F 38/08*** | (2006.01) |

(52) U.S. Cl.

CPC ..... *H01F 27/346* (2013.01); *H01F 27/2823* (2013.01); *H01F 27/34* (2013.01); *H01F 27/40* (2013.01); *H01F 38/08* (2013.01)

(58) Field of Classification Search

CPC ... H01F 27/2823; H01F 27/346; H01F 27/40; H01F 27/34; H01F 38/08

USPC ..... 336/160, 184, 181, 178, 5

See application file for complete search history.

(56) References Cited

U.S. PATENT DOCUMENTS

| | | | | |
|---|---|---|---|---|
| 1,467,771 | A * | 9/1923 | Alden | 336/155 |
| 4,296,395 | A | 10/1981 | Moritz | |
| 5,736,827 | A | 4/1998 | Dohnal | |
| 6,483,202 | B1 | 11/2002 | Boys | |
| 7,405,951 | B2 | 7/2008 | Tsuruya | |
| 8,223,515 | B2 | 7/2012 | Abolhassani | |
| 2011/0248808 | A1 | 10/2011 | Singh | |

FOREIGN PATENT DOCUMENTS

| | | | |
|---|---|---|---|
| DE | 2856584 A | | 7/1980 |
| JP | 05-082364 A | * | 4/1993 |

* cited by examiner

*Primary Examiner* — Mangtin Lian
(74) *Attorney, Agent, or Firm* — Andrew Wilford

(57) ABSTRACT

The invention relates to a power transformer with electronic components. The aim of the invention is to arrange the energy supply of the electronic components of a power transformer closer to the components and thus eliminate the disadvantages of the prior art. According to the invention, a stray field collector is brought into a stray field of the power transformer, whereby a voltage is generated.

3 Claims, 2 Drawing Sheets

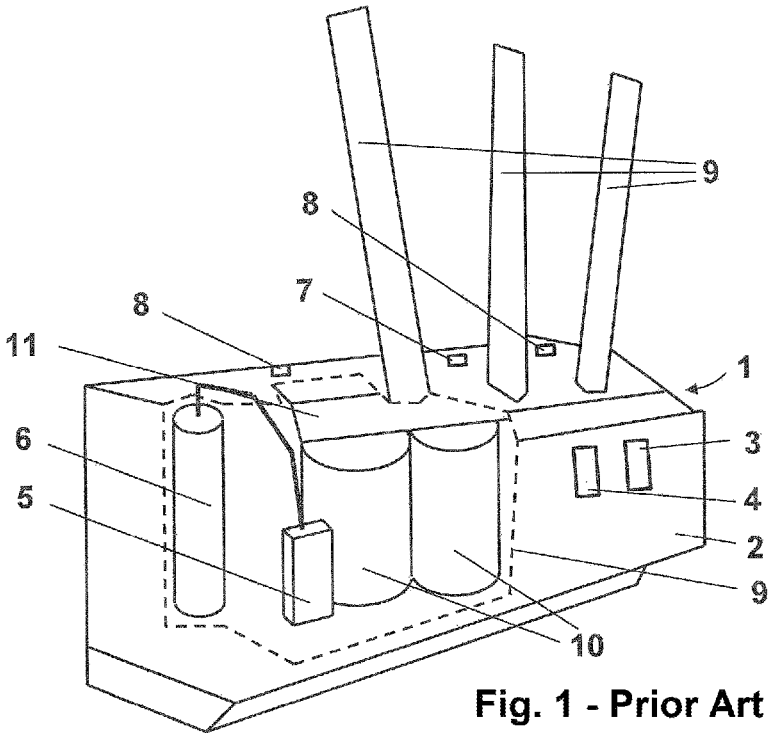
Fig. 1 - Prior Art
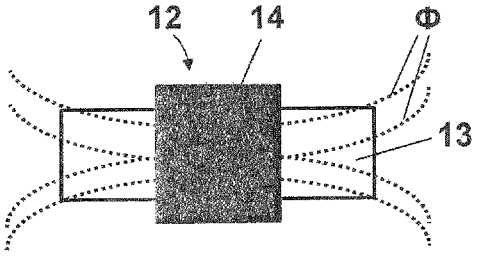
Fig. 2
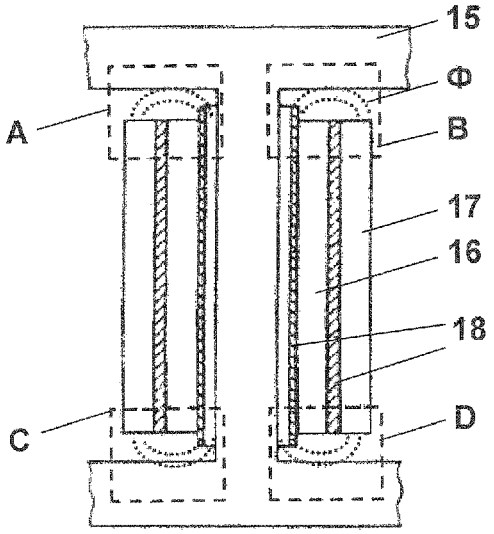
Fig. 3

Fig. 4
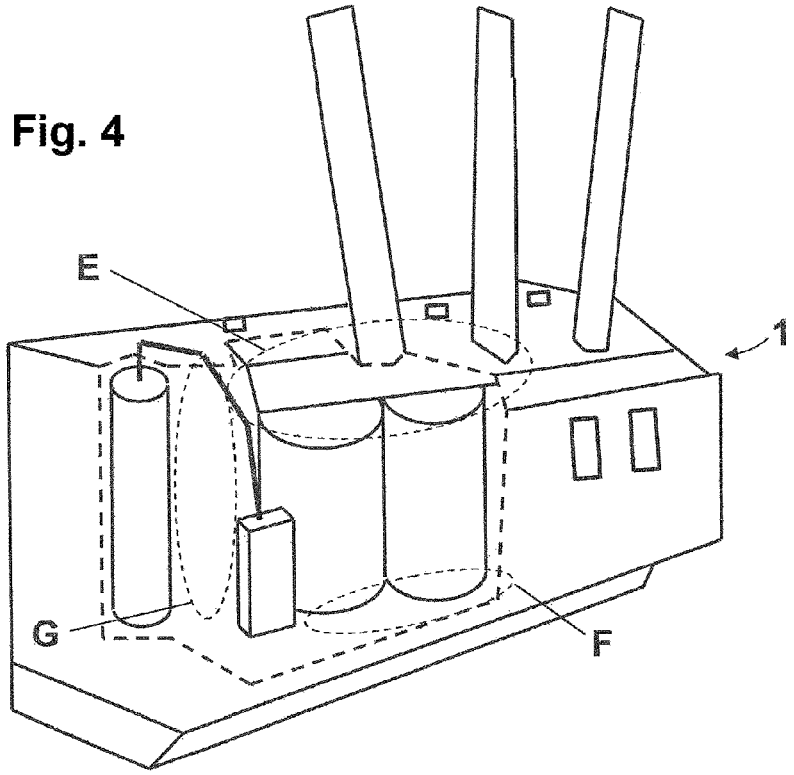
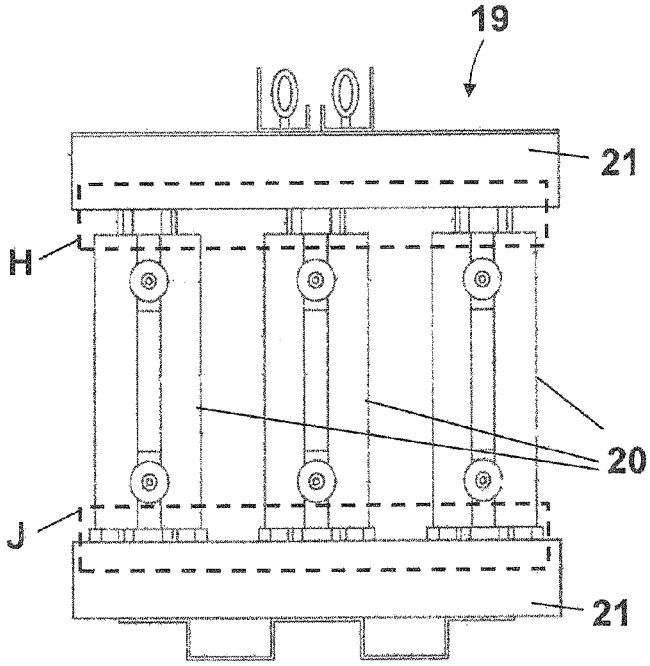
Fig. 5

POWER TRANSFORMER WITH ELECTRONIC COMPONENTS

CROSS REFERENCE TO RELATED APPLICATIONS

This application is the US-national stage of PCT application PCT/EP2013/053175 filed 18 Feb. 2013 and claiming the priority of German patent application 102012102398.0 itself filed 21 Mar. 2012.

FIELD OF THE INVENTION

The invention relates to a power transformer with electronic components.

BACKGROUND OF THE INVENTION

A tap changer with a motor drive is known from DE 4214431 [U.S. Pat. No. 5,736,827]. It is mounted outside the housing of a power transformer. The motor drive consists of numerous individual parts, inter alia also numerous electronic components. Belonging thereto are, for example, a drive motor, setting transmitter, microcontroller and evaluating unit. In order to ensure reliable operation of these electronic components, each component needs a voltage supply. In the case of the motor drive the voltage supply is realized by a single cable that connects it with a nearby voltage source.

Apart from the motor drive, numerous other electronic components are found in modern power transformers. Amongst these are numerous safety devices such as, for example, Buchholz relays, temperature sensors, air dehumidifiers and gas-in-oil sensors. They also each need a voltage source for operation. These safety devices are similarly arranged in the vicinity of the transformer and are connected with safety devices by respective cables. Since, for example, the Buchholz relay is mounted in the upper part of the power transformer. cabling, which is placed outside the housing, to the voltage source is correspondingly lengthy.

This conventional form of voltage supply, namely by lengthy cables with physically separate voltage sources, of the electronic components of the power transformers has numerous disadvantages. Since power transformers are frequently in use for several decades the cables also have to ensure reliable functioning during this time. Since, however, the plastic casing is exposed to different weathering conditions (rain, ultraviolet radiation, etc.) cable cracking or even breakages can occur. Due to the comparatively low voltage level that auxiliary apparatus requires, a special line provided only for these applications is required. This is not only cost-intensive, but also connected with a large amount of effort, since power transformers are often in districts without a low-voltage supply. The multiplicity of electronic components require special expert knowledge for installation, since errors can quickly occur during wiring. The remote voltage sources additionally hamper this. Notwithstanding these disadvantages, a voltage supply of the electronic components is necessary.

Object of the Invention

The object of the invention is to get the voltage supply of the electronic components of a power transformer closer and thus to eliminate the disadvantages of the prior art.

SUMMARY OF THE INVENTION

This object is fulfilled by a power transformer with electronic components having a stray field collector arranged directly in a leakage flux of the power transformer.

Power transformers are a special form of transformer that are mostly used in electric energy mains. These can be designed to be very large and are in a position of transforming voltages of several hundred kilovolts. They usually consist of three ferromagnetic cores as well as at least two conductors (windings) wound around each of the cores. This construction is known from, inter alia, DE 2943626 [U.S. Pat. No. 4,296,395] and US 2011/0248808. The cores are connected together at the upper and lower ends by a yoke and arranged in a row. A first conductor is initially wound around each core. This is termed first winding. Insulating material is provided between the core and the first winding so as to electrically separate the two parts from one another. A second winding is provided around the first winding. The two windings are similarly electrically separated from one another by insulating material. In the case of an ideal transformer the voltages at the windings due to electromagnetic induction are proportional to the rate of change of the magnetic flux and to the number of turns in the winding. Consequently, the voltages behave relative to one another as per the winding numbers. However, this statement applies only in theory, since the most diverse influences are imposed on efficiency and reduce this. Belonging thereto are, inter alia, the resistances of the windings, eddy current losses, permeability of the core and magnetic leakage fluxes.

Different measures have been undertaken in order to diminish or at least reduce these influences. In order to reduce any current losses, the core of a power transformer is, for example, constructed not to be solid, but from numerous thin metal sheets layered one on the other. Leakage fluxes can be reduced by tight arrangements of the windings relative to one another, materials with high magnetic conductivity in the core and, in particular, design of the transformers. However, it has not been possible to completely eliminate the leakage fluxes. These leakage fluxes can be used by a stray field collector as energy supply.

BRIEF DESCRIPTION OF THE DRAWING

The invention is discussed in more detail with reference to the accompanying drawings, in which:

FIG. 1 shows a prior-art power transformer with electronic components,

FIG. 2 shows a stray field collector according to the invention,

FIG. 3 shows a stray field collector according to the invention directly at a winding of a power transformer, FIG. 4 shows a power transformer with possible locations for mounting the stray field collector according to the invention and FIG. 5 shows a further power transformer with possible locations for mounting of the stray field collector according to the invention.

SPECIFIC DESCRIPTION OF THE INVENTION

FIG. 1 shows a prior-art power transformer 1 with electronic components. At the outer walls 2 are, inter alia, a temperature sensor 3, load current meter 4 and drive unit 5 that drives an on-load tap changer 6 provided in the interior. A Buchholz relay 7 and two air dehumidifiers 8 are mounted in the upper region. The detail 9 shows the windings 10, which are present in the interior of the power transformer 1, as well as a schematically indicated yoke 11 that surrounds this. Also present in the upper region are insulators 12 by which the power transformer 1 is connected with high-voltage lines.

The electronic components are in that case connected with one another and with an external voltage supply.

FIG. 2 shows a stray field collector 12 according to the invention consisting of a core 13 and a coil 14. If the stray field collector 12 is mounted in a alternating magnetic flux, more precisely stray flux Φ, of an alternating current transformer then a voltage is induced in the coil 12. This voltage can be used for the purpose of supplying different electronic components, which are provided in the vicinity of a power transformer, with energy. The core 13 of the stray field collector 12 is not absolutely necessary. This serves merely for reinforcing inductivity. If the stray field Φ is sufficiently strong, only the coil 14 is needed.

FIG. 3 shows a winding arrangement known from DE 2943626 A1 (FIG. 4) consisting of a winding core 15, a first winding 16 and a second winding 17. An insulating material 18 is provided not only between the first winding 16 and the winding core 15, but also between the first winding 16 and the second winding 17 so as to electrically separate all parts from one another. On application of an alternating voltage to the first winding 16 an alternating magnetic flux is generated in the winding core 15 due to electromagnetic induction. The magnetically alternating flux in turn induces a voltage in the second winding 17. The magnetic flux, which runs outside the winding core 15 (stray flux Φ), arises, inter alia, in the marked regions A-D and is particularly large here. Through positioning of a stray field collector 12 in these regions the undesired stray flux Φ can be used to obtain energy.

FIG. 4 shows the power transformer 1, which is known from the prior art, with possible positions E, F, G for mounting of one or more stray field collectors 12.

FIG. 5 shows a further power transformer that is known from US 2011/0248808 (FIG. 2). The three-phase power transformer 19 comprises three winding arrangements 20 that are connected at the upper and lower ends with one another by a yoke 21. The regions H, J denote further positions at which one or more stray field collectors 12 can be provided. In the case of this arrangement, the yoke 21 can be used instead of the core 13.

Of particular advantage of the invention is the fact that energy, which is undesirably lost, of the stray fields is used and thereby the entire system achieves a higher level of efficiency. The obtained energy can be used for, for example, sensors, the actuation of semiconductor switches, a drive or simple status displays. In that case the stray field collector 12 can be used not just in the high-voltage field. Applications are also possible in the medium-voltage and low-voltage field. Only adaptation of the coil 14 of the stray field collector 12 is needed.

The invention claimed is:

1. A power transformer comprising:

electronic components, a yoke having a leg;

a winding surrounding the leg and generating a stray field on energization of the transformer; and a stray field collector for supplying voltage to the electronic components and including a magnetic core and a coil around the core, outside the yoke and the winding, in the stray field of the transformer, and positioned such that current is induced by the stray field in the coil of the field collector for supply to the components.

2. The power transformer according to claim 1, wherein the winding of the power transformer includes a first winding and a second winding, the yoke being juxtaposed with the at least one stray field collector.

3. The power transformer according to claim 2, wherein the coil of the stray field collector is around the yoke of the power transformer.

* * * * *